US005848834A

United States Patent [19]

Kerr

[11] Patent Number: 5,848,834

[45] Date of Patent: Dec. 15, 1998

[54] FLASHLIGHT HOLDER

[76] Inventor: Daniel G. Kerr, 2922 East 25th Avenue, Vancouver, British Columbia, Canada, V5R 1J2

[21] Appl. No.: 14,037

[22] Filed: Jan. 27, 1998

Related U.S. Application Data

[63] Continuation-in-part of Ser. No. 713,217, Sep. 12, 1996, Pat. No. 5,743,623.

[51] Int. Cl.[6] ..... F21L 7/00

[52] U.S. Cl. ..... 362/190; 362/110; 362/208; 362/399

[58] Field of Search ..... 362/190, 191, 362/110, 202, 205, 208, 399

[56] References Cited

U.S. PATENT DOCUMENTS

| | | | |
|---|---|---|---|
| 3,418,461 | 12/1968 | Sedlock | 362/191 |
| 5,167,446 | 12/1992 | Haroutunian | 362/110 |
| 5,580,157 | 12/1996 | Patricca et al. | 362/191 |
| 5,601,356 | 2/1997 | McWilliams | 362/103 |
| 5,743,623 | 4/1998 | Kerr | 362/190 |

*Primary Examiner*—Stephen F. Husar

[57] ABSTRACT

A flashlight holder for use with flashlights and which permits the user to control the flashlight while handling another item, such as a firearm. The flashlight holder has a removably attachable collar coupled to a handle. The handle is dimensioned so as to permit the user to control a flashlight to which the collar is attached by holding the handle with a few fingers while making the same hand available for other activities, such as holding a firearm. In another embodiment, the handle is dimensioned so as to removably attach to the back of the user's hand and at least a portion of the palm.

20 Claims, 6 Drawing Sheets

FLASHLIGHT HOLDER

RELATED APPLICATIONS

This application is a continuation-in-part of U.S. patent application Ser. No. 08/713,217 filed Sep. 12, 1996 and now issued as U.S. Pat. No. 5,743,623.

FIELD

The present invention relates to a flashlight holder for use with flashlights and which permits the user to control the flashlight while handling another item, such as a firearm. The flashlight holder may be removably attached to or may be integral with and form part of the flashlight casing.

BACKGROUND

Conventional flashlight handles, while useful, make it difficult for the user to hold the handle while using the hand for other activities, and as such are unsuitable or undesirable in certain circumstances. For instance, in the area of law enforcement and security operations, it is desirable that a flashlight handle enable the user to readily hold and direct the flashlight while freeing up the same hand for other uses, such as for the control of a firearm. Moreover, many flashlights lack handles altogether. In order to control both a firearm and a flashlight in combination, officers are typically required to hold a flashlight in one hand while holding the firearm in the other, thereby compromising the support and stability that is otherwise available in employing a firearm with two hands. One method of reducing some of the loss of support arising when dedicating one hand to employing a flashlight is for an officer to extend the arm with the hand holding the firearm across and on top of the arm with the hand holding the flashlight. This method, however, requires constant readjustment when an officer is in motion or after discharging a firearm and does not direct the beam of light directly along the light of sight of the firearm muzzle. Existing flashlights with built-in holders aggravate the problems as the holder design is uncomfortable and difficult to grip when using a device such as a firearm. Furthermore, existing flashlights with built-in holders have a design which makes it impractical for an officer to wear such a flashlight around the waist when it is not in use.

In co-owned U.S. patent application Ser. No. 08/713,217, now issued as U.S. Pat. No. 5,743,623, there is provided a flashlight holder which attends to the above needs in the art and enables a user to readily hold a flashlight in combination with a firearm. While the flashlight holder in U.S. patent application Ser. No. 08/713,217 provides a useful improvement in the art, additional flashlight holder structures presented herein have been invented which offer alternative means for controlling a flashlight with a hand while enabling the user to make use of the same hand for other activities. Moreover, with the variety of flashlights on the market, there remains a continuing need for alternative flashlight holders.

Accordingly, it is an object of the invention to provide alternative and improved means of support for flashlights having no holder. It is a further object of this invention provide an improved means of holding a flashlight when using another article or device, such as a firearm.

SUMMARY OF THE INVENTION

According to the invention there is provided a flashlight holder for use in combination with a flashlight, the flashlight holder comprising a collar, a spacer arm and a gripping arm. The collar is operative to slidably attach to a flashlight housing proximate a flashlight head. The spacer arm is dimensioned to fit between a thumb and an index finger and is coupled to the collar so as to extend outwardly therefrom. The gripping arm is dimensioned to rest snugly in the palm of a hand and is coupled to the spacer arm at a junction remote from the collar and forms an oblique angle with the spacer arm. In this embodiment, the spacer arm has a length sufficient to permit a user to hold the gripping arm in the palm of the user's hand with the spacer arm between the user's thumb and index finger while the collar is attached to the flashlight housing proximate the flashlight head so as to permit the user to control the flashlight.

The spacer arm may have a substantially flat-faced body so as to fit snugly between the thumb and index finger. The spacer arm can include a finger notch.

The collar may include an elongated base from which the spacer arm extends such that the spacer arm is coupled to a distal end of the base and the base is dimensioned so that the user's hand fits snugly against the base when the gripping arm is held in the palm of the hand. The elongated base, spacer arm and gripping arm can be coupled to form a U-like handle which fits between the thumb and index finger.

The collar may include a threaded aperture operative to receive a set screw so as to firmly engage the collar to the flashlight housing. The collar may be tubular and include a friction enhancing surface on an interior surface thereof. The collar may have a split tubular shape. The collar may also have a cutout dimensioned to fit around a manual on/off switch so as to lock the collar to the flashlight housing without interferring with the on/off switch.

In one embodiment, the flashlight holder comprises a collar and a band-like body which forms a handle. The band-like body is coupled to the collar and dimensioned to encircle the back of a user's hand and at least a portion of the user's palm. The band-like body includes an inner sidewall dimensioned to fit snugly against a back of the user's hand so as to permit a user to hold the band-like body while the collar is attached to the flashlight housing. In this embodiment, the collar extends from an outer surface of the band-like body so as to be positioned proximately above the back of the user's hand when the band-like body is held by the user. The band-like body may include two distal curved ends dimensioned to rest snugly in the palm of the user's hand such that the band-like body has an flattened C-like cross-section. This embodiment may also include means for pivotally coupling the collar to the band-like body so as to permit the band-like body to be pivoted relative to the collar.

In another embodiment of the invention, the flashlight holder comprises a collar coupled to a band-like body, wherein the band-like body is coupled to the collar and dimensioned to permit a number of fingers to snugly fit therethrough so as to permit a user to hold the band-like body. The collar is operative to attach to the flashlight housing and extends from the band-like body such that while the collar is attached to the flashlight housing and the band-like body is held by a user, the flashlight is positionable on the back-side of the user's hand. The band-like body serves as a handle which is to be held by one or more fingers and may be oriented at an oblique angle to the collar. The band-like body may form a ring operative to be held by a single finger. Alternatively, the band-like body may be dimensioned so as to be held by two or more fingers.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

Figure 1:
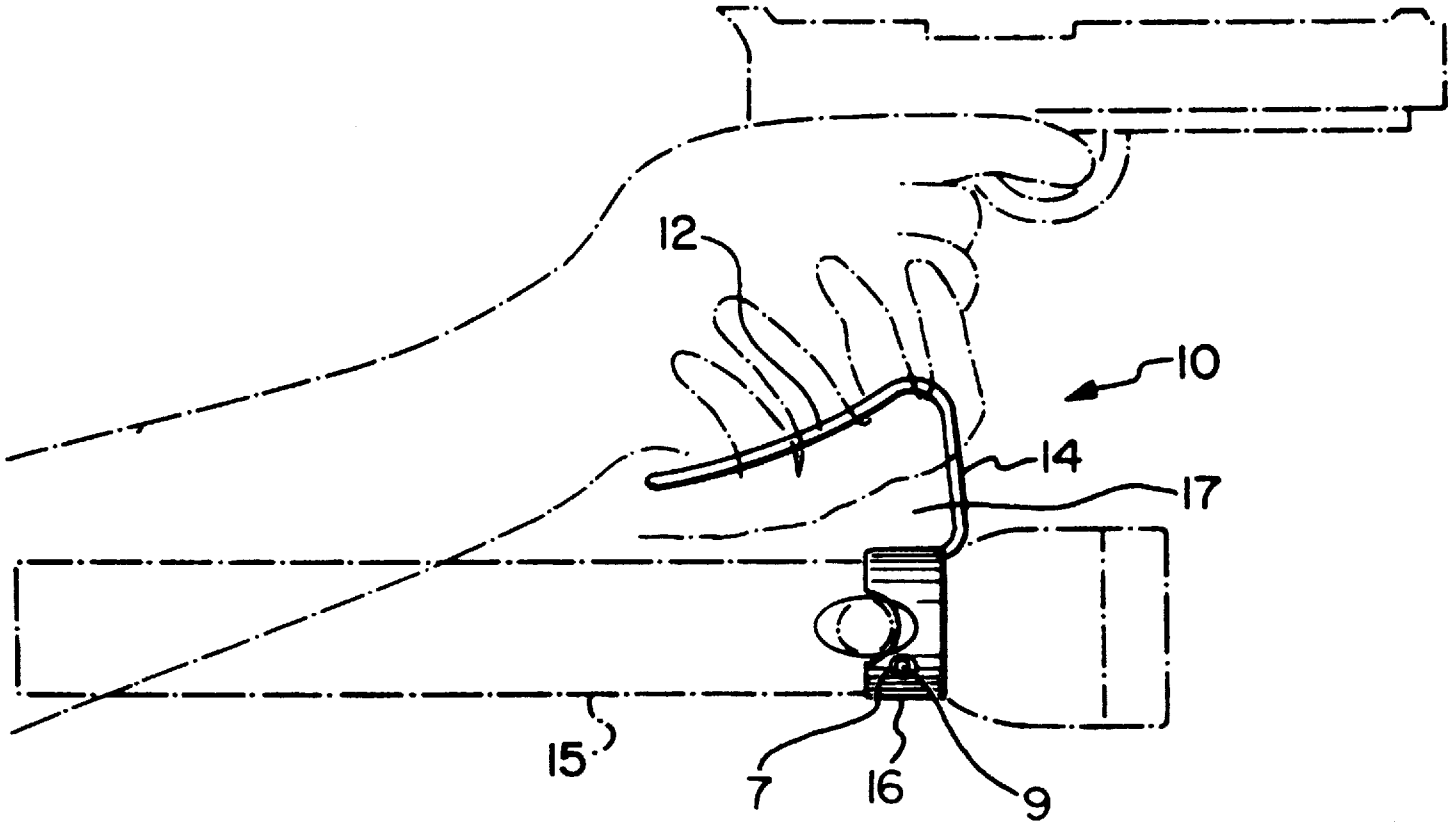
FIG. 1 is a side view of a flashlight holder attached to a flashlight and carried in one hand simultaneously while the other hand is holding a gun.

It will be appreciated that for simplicity and clarity of illustration, elements illustrated in the accompanying drawings have not necessarily been drawn to scale. For example, the dimensions of some of the elements are exaggerated relative to other elements for clarity. Furthermore, where considered appropriate, reference numerals have been repeated among the drawings to indicate corresponding or analogous elements.

DETAILED DESCRIPTION WITH REFERENCE TO THE DRAWINGS

Referring to FIG. 1, there is illustrated flashlight holder 10 from applicant's co-owned U.S. patent application Ser. No. 08/713,217, now issued as U.S. Pat. No. 5,743,623, the whole of which is incorporated hereto. Flashlight holder 10 comprises cantilevered arm 12, spacer 14 and tubular collar 16. Spacer 14 extends outwardly from collar 16 and is dimensioned so that when collar 16 is attached to the housing of a flashlight 15 a passageway 17 is formed between the flashlight 15 and arm 12. Holder 10 is attachable to flashlight 15 by spreading apart collar 16 and sliding collar 16 into place along the housing of flashlight 15. Once collar 16 is located substantially close to the head of flashlight 15, the arms of collar 16 are released allowing collar 16 to clamp or frictionally attach to flashlight 15. Collar 16 may include threaded aperture 7 with set screw 9 inserted therethrough. Collar 16 may be further firmly engaged to the housing of flashlight 15 by tightening set screw 9 into threaded aperture 7 so that the set screw firmly abuts the flashlight housing. An interior sidewall of collar 16 may also include grooved serrations or frictionally adhesive material so as to improve the frictional engagement of collar 16 to a flashlight housing.

Figure 2:
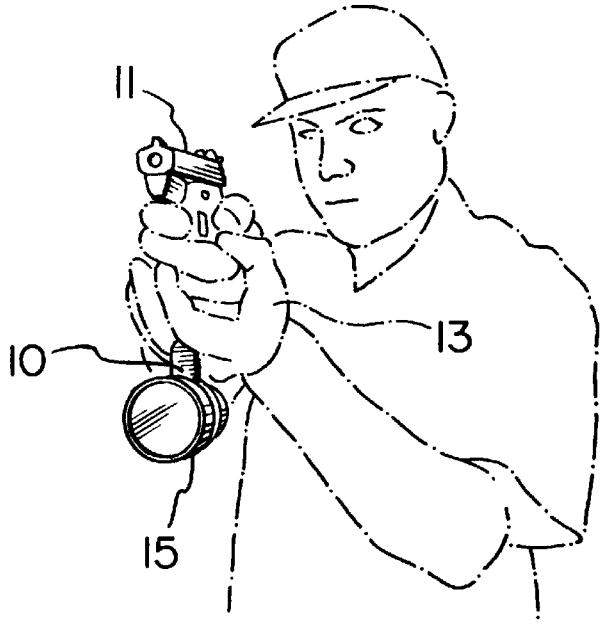
FIG. 2 is a perspective view of a user holding the flashlight holder from FIG. 1 so as to control a flashlight and a firearm.

As shown in FIG. 2, flashlight holder 10 enables the user to hold a flashlight 15 with a hand 13 while permitting the user to freely use hand 13 for other purposes, such as retaining a firearm 11.

Figure 3:
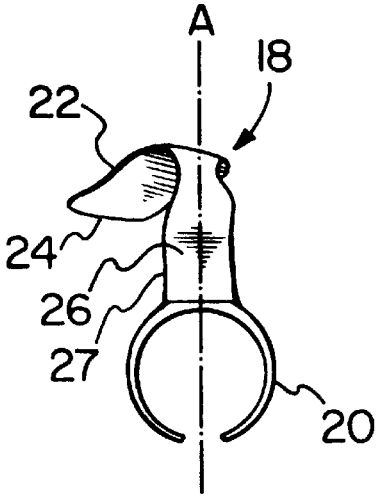
FIG. 3 is a front view of an embodiment of a flashlight holder in accordance with the present invention.
Figure 4:
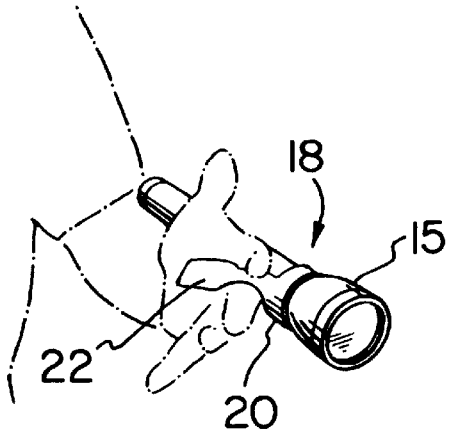
FIG. 4 is a perspective view of the flashlight holder in FIG. 3 as held by a user.
Figure 5:
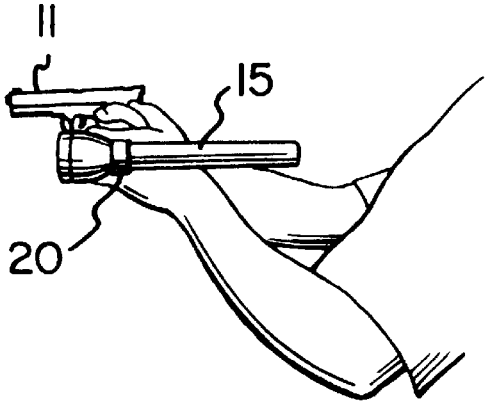
FIG. 5 is a side view of the flashlight holder in FIG. 3 as held by a user.

Referring to FIG. 3, there is shown a modified flashlight holder 18 as contemplated within the scope of the present invention. Flashlight holder 18 includes collar 20 coupled to cantilevered arm 22 having distal end 24. Collar 20 is dimensioned so as to firmly attach to the housing of a flashlight. For illustration purposes, collar 20 may have an annular or penannular cross-section. Cantilever arm 22 is arranged to extend from spacer 26 at an oblique angle such that distal end 24 is more to one side 27 of spacer 26. In this way, cantilevered arm 22 can extend away from axis A of spacer 26. Advantageously, when arm 22 is oriented to extend to one side 27 of spacer 26 at an oblique angle, flashlight holder 18 may be more readily used to hold a flashlight 15 alongside a user's arm, as illustrated in FIGS. 4 and 5. Flashlight holder 18 thus allows a user to hold flashlight 15 alongside firearm 11 such that the flashlight can be directed in an alternative way substantially towards the line of fire of firearm 11. In FIGS. 4 and 5, flashlight holder 18 is shown coupled to a larger flash light, such as a Mag-Lite™, however, it will be appreciated that invention is contemplated for use with other types of flashlights, both large and small.

Figure 6:
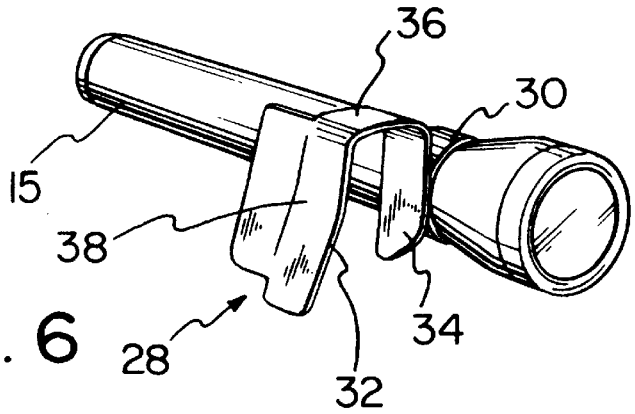
FIG. 6 is a perspective view of another embodiment of a flashlight holder coupled to a flashlight in accordance with the present invention.
Figure 7:
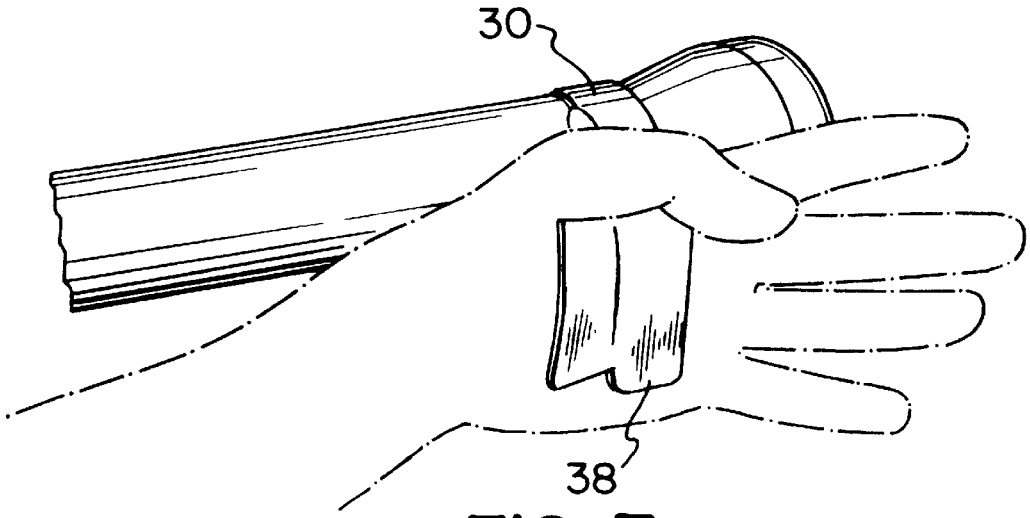
FIG. 7 is a perspective view of the flashlight holder in FIG. 6 as held by a user.
Figure 8:
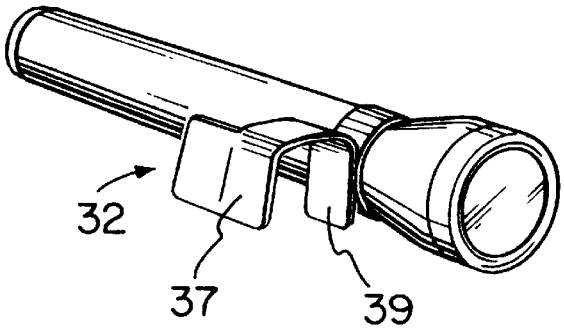
FIG. 8 is a perspective view of an embodiment of a flashlight holder in accordance with the present invention.
Figure 9:
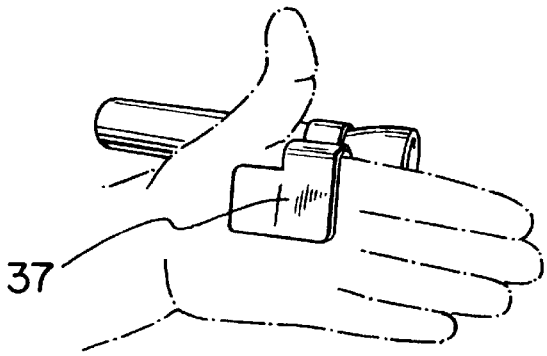
FIG. 9 is a side view of the flashlight holder in FIG. 8 as held by a user.

Referring to FIG. 6, another embodiment is shown wherein flashlight holder 28 comprises collar 30 coupled to handle 32. Collar 30 is operative to clamp to the housing of flashlight 15 and is shown coupled to handle 32 at base 34. Handle 32 includes spacer 36 and gripping arm 38. Spacer 36 extends outwardly from collar 30 proximate an end of base 34 and is dimensioned to permit a hand to snugly rest between gripping arm 38 and base 34. Spacer 36 is further dimensioned to fit between the thumb and index finger, as can be seen in FIG. 7. Gripping arm 38 is dimensioned to rest comfortably in the palm of a hand. In the embodiment shown in FIG. 7, base 34, spacer 36 and gripping arm 38 are arranged so that handle 32 has a U-like cross section. Preferably, holder 28 enables a user to position a flashlight on the back-side of the user's hand so that, for instance, the user may use the same hand to grip a portion of a firearm held in the other hand. For smaller flashlights, handle 32 may have a gripping arm 37 which is dimensioned to extend only partially across the palm of a hand fitted between gripping arm 37 and base 39, as depicted in FIGS. 8 and 9. Such an embodiment offers the user a more compact model.

Figure 10:
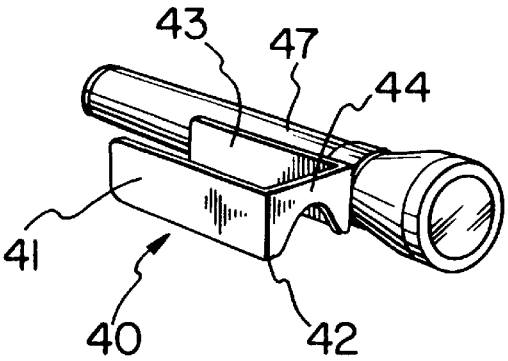
FIG. 10 is a perspective view of another embodiment of a flashlight holder coupled to a flashlight in accordance with the present invention.
Figure 11:
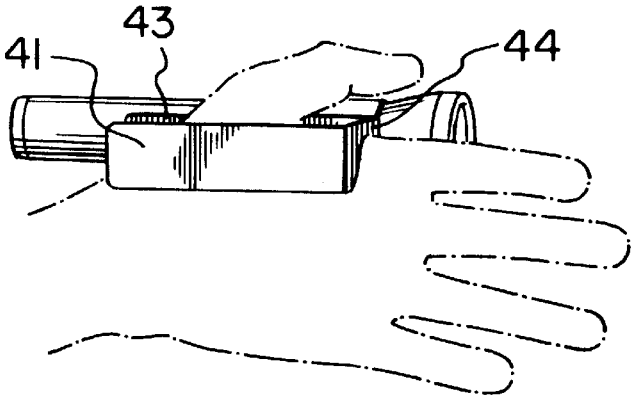
FIG. 11 is a side view of the flashlight holder in FIG. 10 as employed by a user.

Referring to FIG. 10, flashlight holder 40 includes handle 42 having two substantially parallel sidewalls 41 and 43 separated from one another by spacer 44 which is dimensioned to fit snugly between a user's thumb and the user's index finger. Preferably, sidewalls 41 and 42 are aligned with spacer 44 such that handle 42 has a U-like cross section so as to permit handle 42 to be readily held by a user's thumb without slipping out of position on the hand, as illustrated in FIG. 11.

Figure 12:
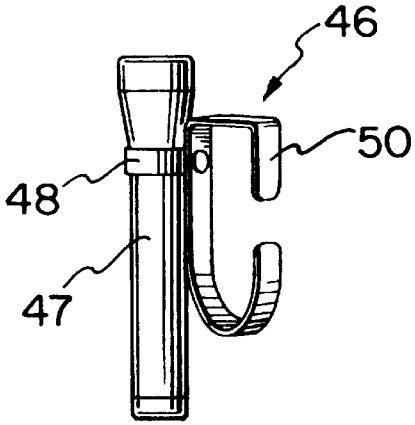
FIG. 12 is a perspective view of another embodiment of a flashlight holder coupled to a flashlight in accordance with the present invention.
Figure 13:
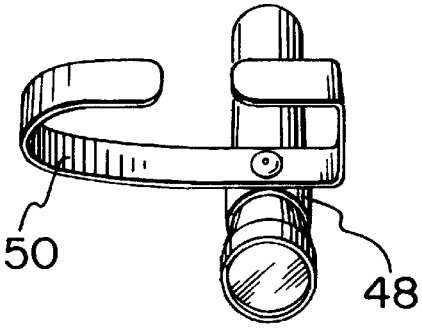
FIG. 13 is a side view of the flashlight holder in FIG. 12 as employed by a user.
Figure 14:
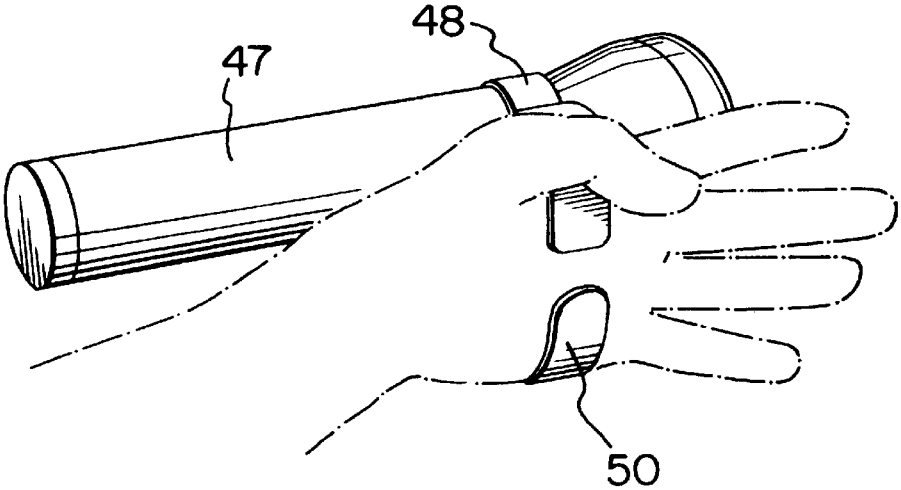
FIG. 14 is a perspective view of the flashlight holder in FIG. 12.

Referring to FIG. 12, flashlight holder 46 includes collar 48 coupled to handle 50 having a band-like shape so as to encircle or partially encircle a portion of a user's hand. Handle 50 advantageously enables the user to control a flashlight with holder 46 while freeing up the user's fingers for other uses, as shown in FIG. 14. As can be seen from the combination of FIGS. 12 and 13, handle 50 may also be pivotally mounted to collar 48 so as to provide improved flexibility and compactness for the user.

Figure 15:
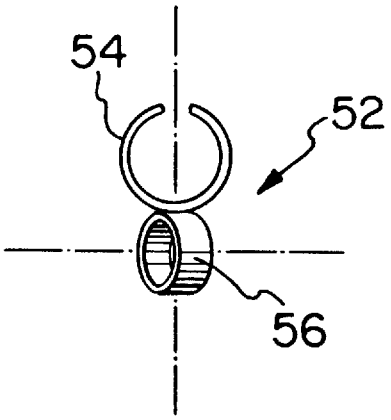
FIG. 15 is a perspective view of another embodiment of a flashlight holder in accordance with the present invention.
Figure 16:
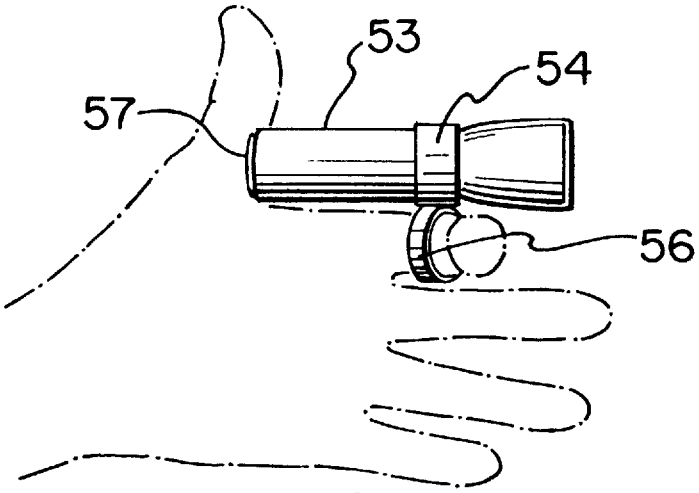
FIG. 16 is a perspective view of the flashlight holder from FIG. 15, coupled to a flashlight and employed by a user, in accordance with the present invention.
Figure 17:
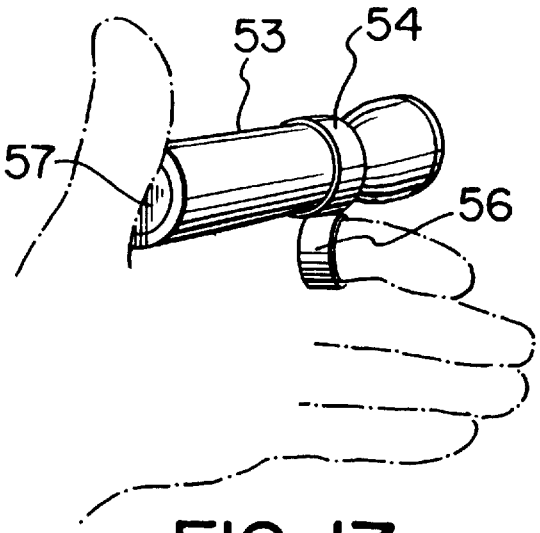
FIG. 17 is another perspective view of FIG. 16.

Referring to FIG. 15, another variant of flashlight holder 52 comprises collar 54 coupled to handle 56 which is shaped in a ring-like manner so as to permit the passage of a user's finger therethrough. Collar 54 may have an annular or penannular cross-section, as may handle 56. Advantageously, collar 54 and handle 56 may be oriented with each other such that a notional plane perpendicular with the axis of revolution C of collar 54 intersects at an oblique angle another notional plane perpendicular with the axis of revolution D of handle 56. As illustrated in FIGS. 16 and 17, orientation of handle 56 with respect to collar 54 such that their respective cross-sections intersect at an oblique angle permits a user to more readily control the direction of a flashlight when flashlight holder 52 is attached thereto. It will be appreciated that although collar 54 and handle 56 are shown such that their cross-sections are substantially in alignment along axis B, a number of different orientations are possible which are also contemplated within the scope of the invention.

Figure 18:
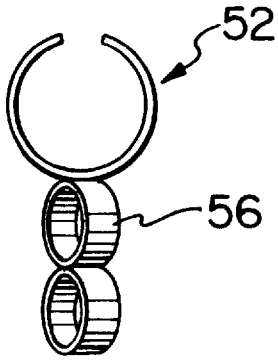
FIG. 18 is a perspective view of another embodiment of a flashlight holder in accordance with the present invention.

Flashlight holder 52 is particularly useful for smaller flashlights, such as the Sure Fire™ 6P which may be obtained from Laser Products of Fountain Valley, Calif. A growing number of such flashlights include a quick control, rear-mounted on/off switch 57 which, when depressed, turns the flashlight on, and otherwise turns the flashlight off. Such a mechanism has been found to be particularly useful and desirable in such areas as law enforcement, where officers often are in need of the ability to quickly turn on and off a flashlight. As with other conventional flashlights, however, there is a continuing need for a device which enables a user to control a flashlight with one hand, while being able to use the same hand to readily control other articles or devices, such as firearms. In the variant illustrated in FIG. 15, it has been discovered that using flashlight holder 52 in combination with a small flashlight 53, a user may readily hold and control the small flashlight using only two fingers of a hand, thereby permitting the user to make use of the same hand for other activities such as concurrently holding a firearm, a truncheon, a police badge or a hand-held radio. As shown in FIG. 18, handle 56 may include a plurality of ring-like bodies, so that a user may control holder 52 with additional fingers.

Figure 19:
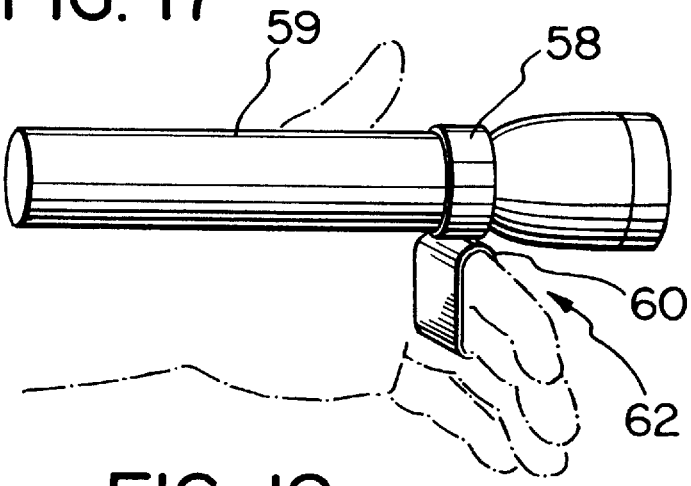
FIG. 19 is a perspective view of another embodiment of a flashlight holder, coupled to a flashlight and employed by a user, in accordance with the present invention.

A larger variant of flashlight holder 52 is illustrated in FIG. 19, wherein handle 60 has a band-like shape and is dimensioned to snugly retain two or more fingers for greater control. In the embodiment shown, handle 60 is aligned with collar 58 at oblique angle so as to permit the user to use the thumb to readily control an on/off switch on a flashlight coupled to the flashlight holder.

Figure 20:
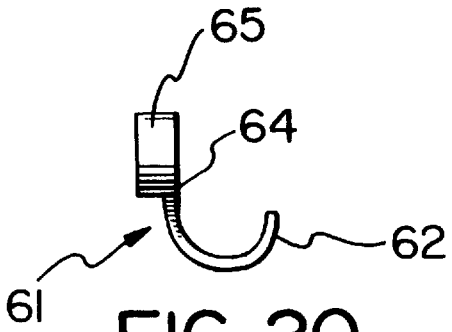
FIG. 20 is a side view of another embodiment in accordance with the invention.
Figure 21:
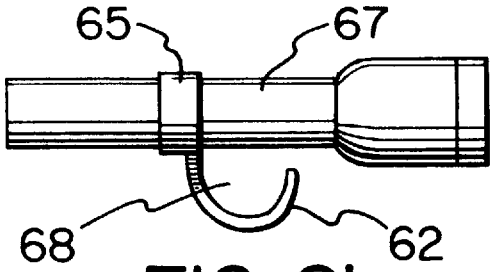
FIG. 21 is a side view of the embodiment in FIG. 20 attached to a flashlight.

Referring to FIG. 20, there is shown another variant of the invention having a ¾ ring 62 which extends to one side 64 of collar 65. As depicted in FIG. 21, when collar 65 is attached to a flashlight housing, a distal end 66 of ¾ ring 62 extends towards and substantially parallel with the flashlight housing 67 so as to form, in combination with the flashlight housing 67, a substantially complete aperture 68 dimensioned to comfortably fit a user's finger. Such an embodiment is preferred when attaching flashlight holder 61 to elongated tubular flashlights having end cap on/off switches so as to provide improved stability for the user controlling such flashlights with holder 61.

Figure 22:
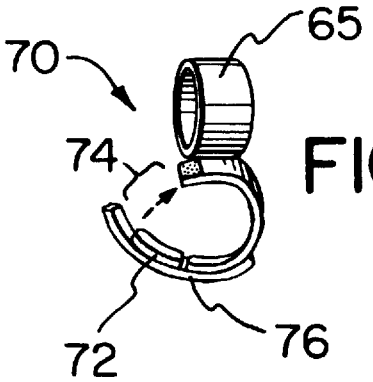
FIG. 22 is a perspective view of another embodiment in accordance with the invention.

Referring to FIG. 22, in another variant of the flashlight holder contemplated herein, handle 70 contains a detachable sidewall section 72. In this variant, sidewall section 72 is large enough such that, when detached from handle 70, a passageway 74 is formed sufficient to permit a user's finger engaging the ring handle 70 to pass therethrough. Detachable sidewall section 72 may be attached to handle 70 with conventional means such as velcro 76 or a hinge. Section 72 offers the user the additional ability to quickly disengage one or more fingers engaging the handle 70.

The flashlight holders illustrated herein may be readily made of known materials, such as metal or plastic.

While the present invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the spirit and scope of the invention.

What is claimed is:

1. A flashlight holder for use in combination with a flashlight, the flashlight holder comprising:

(a) a collar operative to slidably attach to a flashlight housing proximate a flashlight head; and (b) a handle having a band-like body coupled to said collar, said band-like body having a curved hollow cross-section and dimensioned to snugly receive a number of fingers therethrough so as to permit a user to retain said handle with the number of fingers;

wherein said collar extends from said band-like body so as to permit a user holding the band-like body with the number of fingers to control the flashlight while said collar is attached to the flashlight housing.

2. A holder according to claim 1, wherein said band-like body is oriented at an oblique angle to said collar.

3. A holder according to claim 1, wherein said band-like body forms a ring dimensioned to receive one finger snugly therethrough.

4. A holder according to claim 1, wherein said band-like body is dimensioned to receive at least two fingers therethrough.

5. A holder according to claim 1, wherein said collar is tubular and includes a friction enhancing surface on an interior surface thereof.

6. A holder according to claim 1, wherein said collar is a split tubular collar dimensioned to removably engage said flashlight housing proximate the flashlight head.

7. A flashlight holder for use in combination with a flashlight, the flashlight holder comprising:

(a) a collar operative to slidably attach to a flashlight housing proximate a flashlight head; and (b) a handle comprising a band-like body coupled to said collar and dimensioned to encircle the back of a user's hand and at least a portion of the user's palm, said band-like body having an inner sidewall dimensioned to fit snugly against a back of the user's hand so as to permit a user to hold said band-like body while said collar is attached to the flashlight housing;

wherein said collar extends from an outer surface of said band-like body so as to be positioned proximately above the back of the user's hand when said band-like body is held by the user.

8. A holder according to claim 7, wherein said band-like body has two distal curved ends dimensioned to rest snugly in the palm of the user's hand such that said band-like body has an flattened C-like cross-section.

9. A holder according to claim 7, including means for pivotally coupling said collar to said band-like body so as to permit said band-like body to be pivoted relative to said collar.

10. A holder according to claim 7, wherein said collar is tubular and includes a friction enhancing surface on an interior surface thereof.

11. A holder according to claim 7, wherein said collar is a split tubular collar dimensioned to removably engage said flashlight housing proximate the flashlight head.

12. A flashlight holder for use in combination with a flashlight, the flashlight holder comprising:

(a) a collar operative to removably attach to a flashlight housing proximate a flashlight head;

(b) a spacer arm dimensioned to fit between a thumb and an index finger, said spacer arm coupled to said collar and extending outwardly therefrom; and (c) a gripping arm dimensioned to rest snugly in the palm of a hand, said gripping arm coupled to said spacer arm at a junction remote from said collar and forming an oblique angle with said spacer arm;

wherein said spacer arm has a length sufficient to permit a user to hold said gripping arm in the palm of the user's hand with said spacer arm between the user's thumb and index finger while said collar is attached to the flashlight housing proximate the flashlight head so as to permit the user to control the flashlight.

13. A holder according to claim 12, wherein said spacer arm has a substantially flat-faced body so as to fit snugly between the thumb and index finger.

14. A holder according to claim 12, wherein said spacer arm includes a finger notch.

15. A holder according to claim 12, said collar including an elongated base from which said spacer arm extends such that said spacer arm is coupled to a distal end of said base and said base is dimensioned so that the user's hand fits snugly against said base when said gripping arm is held in the palm of the hand.

16. A holder according to claim 15, wherein said elongated base, spacer arm and gripping arm form a U-like handle.

17. A holder according to claim 12, wherein said collar includes a threaded aperture operative to receive a set screw so as to firmly engage said collar to said flashlight housing.

18. A holder according to claim 12, wherein said collar is tubular and includes a friction enhancing surface on an interior surface thereof.

19. A holder according to claim 18, wherein said collar is a split tubular collar dimensioned to removably engage said flashlight housing proximate the flashlight head.

20. A holder according to claim 19, wherein said split tubular collar has a cutout dimensioned to fit around a manual on/off switch so as to lock said split tubular collar to said flashlight housing without interferring with the on/off switch.

* * * * *